US008509463B2

(12) United States Patent
Goh et al.

(10) Patent No.: US 8,509,463 B2
(45) Date of Patent: Aug. 13, 2013

(54) MULTI-MODE SOUND REPRODUCTION SYSTEM AND A CORRESPONDING METHOD THEREOF

(75) Inventors: Aik Hee Daniel Goh, Singapore (SG); Kok Fah Lee, Singapore (SG); Hwee Bun Tan, Singapore (SG)

(73) Assignee: Creative Technology Ltd, Singapore (SG)

( * ) Notice: Subject to any disclaimer, the term of this patent is extended or adjusted under 35 U.S.C. 154(b) by 1230 days.

(21) Appl. No.: 11/938,174

(22) Filed: Nov. 9, 2007

(65) Prior Publication Data

US 2009/0123006 A1 May 14, 2009

(51) Int. Cl.
*H04R 5/02* (2006.01)
*H04R 5/00* (2006.01)

(52) U.S. Cl.
USPC ..... 381/300; 381/307; 381/17

(58) Field of Classification Search
USPC ..... 381/300, 97, 89, 308, 85, 304, 306, 381/98, 99, 307, 17
See application file for complete search history.

(56) References Cited

U.S. PATENT DOCUMENTS 6,681,018 B1 * 1/2004 Asakura et al. ..... 381/18
2007/0263888 A1 * 11/2007 Melanson ..... 381/300
2008/0031462 A1 * 2/2008 Walsh et al. ..... 381/17

* cited by examiner

*Primary Examiner* — Mohammad Islam
*Assistant Examiner* — David Ton
(74) *Attorney, Agent, or Firm* — Creative Technology Ltd

(57) ABSTRACT

There is provided a multi-mode sound reproduction system for reproduction of both stereophonic signals and multi-channel audio signals. The system includes a first pair of speakers positioned on a left portion of a user, the user being at a pre-determined facing, the first pair of speakers comprising a first primary speaker which is stackable with a first secondary speaker; a second pair of speakers positioned on a right portion of the user, the user being at the pre-determined facing, the second pair of speakers comprising a second primary speaker which is stackable with a second secondary speaker. The system may preferably include an arrangement of electronic components for controlling output of audio signals from the first pair and the second pair of speakers. It is preferable that in a first mode with the first and second pair of speakers in an unstacked configuration, the signals do not pass through the arrangement of electronic components prior to output. It is also preferable that in a second mode with each of the first and second pair of speakers in a stacked configuration, the arrangement of electronic components allows either stereophonic signals or multi-channel audio signals to be separately processed and reproduced in the first pair and the second pair of speakers. A corresponding method is also disclosed.

10 Claims, 3 Drawing Sheets

MULTI-MODE SOUND REPRODUCTION SYSTEM AND A CORRESPONDING METHOD THEREOF

FIELD OF INVENTION

The present invention relates to a sound reproduction system with multiple modes to enable optimum sound reproduction quality. The present invention also relates to a method for enabling the aforementioned optimum sound reproduction quality.

BACKGROUND

Personal computers are becoming the preferred entertainment hub in the homes of many people. This practice has become increasingly common in recent times due to changes in the way people obtain entertainment content for their own consumption. There is a nearly infinite amount of entertainment content available in digital form. The digital aspect of entertainment content such as, for example, music and video has led people to treat their personal computer as their entertainment hub since it is generally the main device used to obtain and store the entertainment content.

Music and video content generally have differing demands on an audio playback system due to differences in output signals for music and video content. Nowadays, it is nearly a certainty that digital music content are recorded and distributed in stereo, while movie content is often provided with multi-channel audio signals for play back on multi-channel speaker systems. As such, pairing an appropriate audio reproduction system to the personal computer has become an important decision affecting playback quality of the entertainment content because a choice of either a multi-channel or a stereo system would adversely affect sound reproduction quality of music and video content respectively.

Several speaker systems have been introduced which attempt to play back both stereophonic and multi-channel content in an optimal manner. There are audio systems which rely on bouncing audio signals off walls to simulate surround sound effects. Another type of system is like that of the PS2000 system from Creative Technology Ltd which utilizes audio processing algorithms to provide the requisite surround effects. Both of the aforementioned systems have gotten both plaudits and brickbats. The mixed reception stems from the fact that the systems which rely on bouncing signals off walls are heavily dependent on where it is located with respect to walls (as these systems do not work well in nearfield applications) while the PS2000 is heavily dependent on an anatomical structure of a person, specifically, head size, shape, and pinea structure.

Thus, there exists a need for a sound reproduction system which is able to consistently reproduce music and video content at an optimal level regardless of location or anatomical structure of a person.

SUMMARY

In a first aspect, there is provided a multi-mode sound reproduction system for reproduction of both stereophonic signals and multi-channel audio signals. The system includes a first pair of speakers positioned on a left portion of a user, the user being at a pre-determined facing, the first pair of speakers comprising a first primary speaker which is stackable with a first secondary speaker; a second pair of speakers positioned on a right portion of the user, the user being at the pre-determined facing, the second pair of speakers comprising a second primary speaker which is stackable with a second secondary speaker. The system may preferably include an arrangement of electronic components for controlling output of audio signals from the first pair and the second pair of speakers. Preferably, the pre-determined facing is towards the at least one driver of the primary speakers.

It is preferable that in a first mode with the first and second pair of speakers in an unstacked configuration, the signals do not pass through the arrangement of electronic components prior to output. It is also preferable that in a second mode with each of the first and second pair of speakers in a stacked configuration, the arrangement of electronic components allows either stereophonic signals or multi-channel audio signals to be separately processed and reproduced in the first pair and the second pair of speakers. Each speaker may include at least one driver.

It is advantageous that the arrangement of electronic components forms a device such as, for example, low pass filter, high pass filter, band-pass filter, crosstalk canceller, any combination of the aforementioned and so forth. Preferably, stacking of speakers is detectable by using a detector such as, for example, a light sensor, a force sensor, and a mechanical switch. The stacking may be either vertical or horizontal.

In a second aspect, there is provided a method for reproduction of both stereophonic signals and multi-channel audio signals using a sound reproduction system with a first pair of speakers comprising a first primary speaker and a first secondary speaker, and a second pair of speakers comprising a second primary speaker and a second secondary speaker. The method includes determining whether input signals are either stereophonic or multi-channel; determining a physical configuration of the first pair of speakers and the second pair of speakers; and reproducing the input signals depending on at least one of: a type of the input signals, and the physical configuration.

It is preferable that in a first mode with the first and second pair of speakers in an unstacked configuration, the signals do not pass through the arrangement of electronic components prior to output. It is also preferable that in a second mode with each of the first and second pair of speakers in a stacked configuration, the arrangement of electronic components allows either stereophonic signals or multi-channel audio signals to be separately processed and reproduced in the first pair and the second pair of speakers. Each speaker may include at least one driver.

It is advantageous that the arrangement of electronic components forms a device such as, for example, low pass filter, high pass filter, band-pass filter, crosstalk canceller, any combination of the aforementioned and so forth. Preferably, stacking of speakers is detectable by using a detector such as, for example, a light sensor, a force sensor, and a mechanical switch. The stacking may be either vertical or horizontal.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

Figure 1:
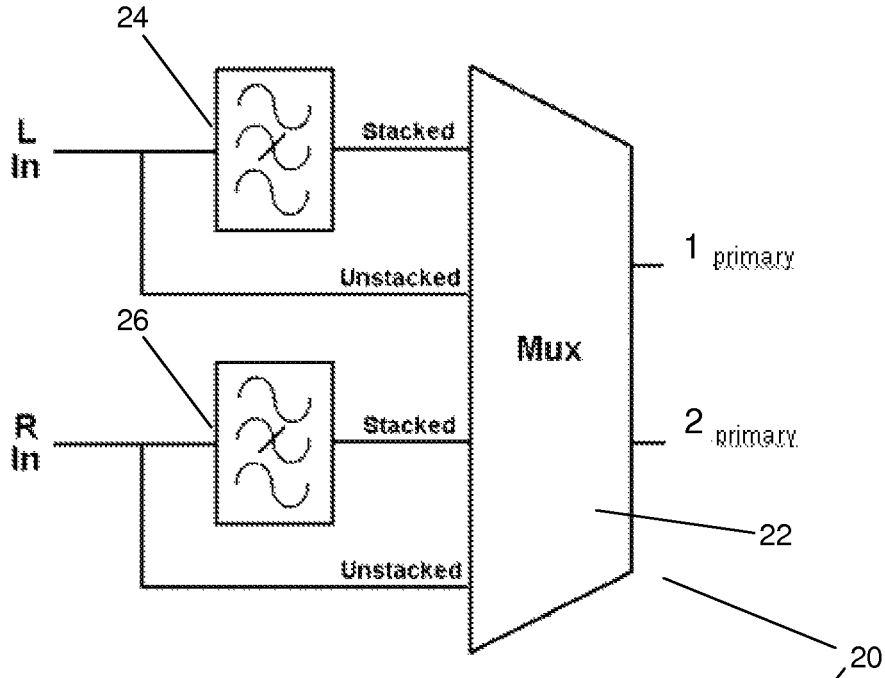
FIG. 1 shows a schematic diagram of primary speakers of the sound reproduction system.
Figure 2:
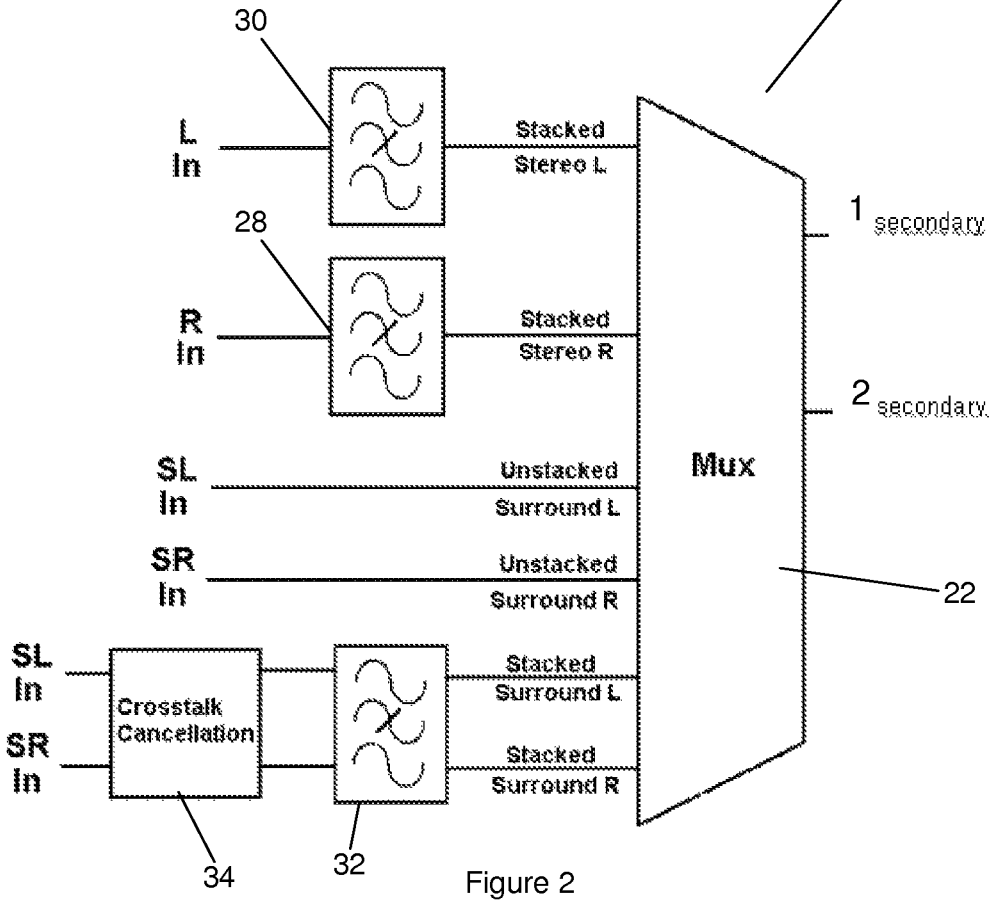
FIG. 2 shows a schematic diagram of secondary speakers of the sound reproduction system.

In a first aspect, there is shown in FIGS. 1 and 2, schematic diagrams for a multi-mode sound reproduction system 20 for reproduction of both stereophonic signals and multi-channel audio signals. FIG. 1 shows possible paths for audio signals which pass into primary speakers which belong to a first pair of speakers ($\mathbf{1}_{primary}$) and a second pair of speakers ($\mathbf{2}_{primary}$) of the multi-mode sound reproduction system 20. Similarly, FIG. 2 shows possible paths for audio signals which pass into secondary speakers which belong to the first pair of speakers ($\mathbf{1}_{secondary}$) and the second pair of speakers ($\mathbf{2}_{secondary}$) of the multi-mode sound reproduction system 20. The first pair of speakers may be left speakers while the second pair of speakers may be right speakers. Alternatively, the first pair of speakers may be right speakers while the second pair of speakers may be left speakers. In FIGS. 1 and 2, components depicted on an opposite side of multiplexers 22 with reference to the speakers are on the input side.

Figure 4:
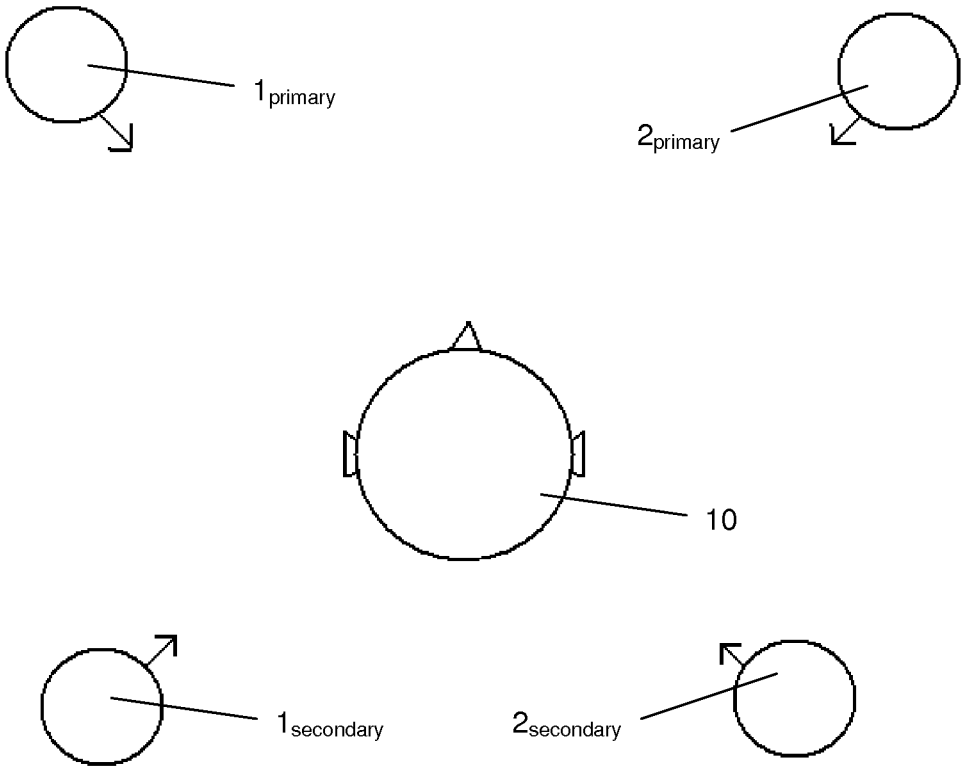
FIG. 4 shows an arrangement for a first mode of the sound reproduction system.
Figure 5:
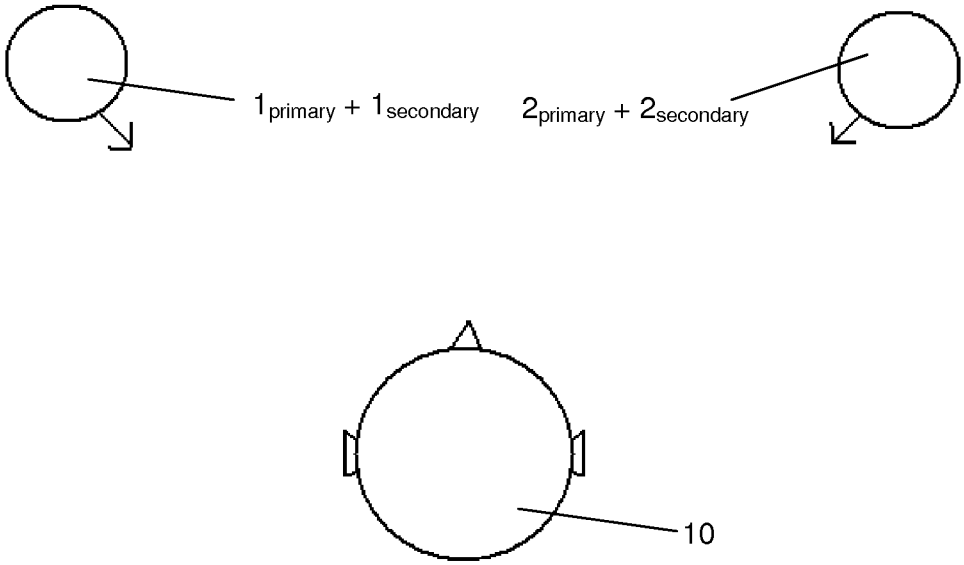
FIG. 5 shows an arrangement for a second mode of the sound reproduction system.

In a non-limiting embodiment, the system 20 includes a first pair of speakers ($\mathbf{1}_{primary}$ and $\mathbf{1}_{secondary}$) positioned on a left portion of a user 10, the user 10 being at a pre-determined facing as shown in FIGS. 4 and 5. The system also includes a second pair of speakers ($\mathbf{2}_{primary}$ and $\mathbf{2}_{secondary}$) positioned on a right portion of the user 10. A preferred scenario in relation to preferred sound reproduction quality is shown in FIGS. 4 and 5, with the user 10 facing the primary speakers ($\mathbf{1}_{primary}$ and $\mathbf{2}_{primary}$), specifically facing at least one driver of each of the primary speakers ($\mathbf{1}_{primary}$ and $\mathbf{2}_{primary}$). It should be noted that the respective primary speakers are stackable with the respective secondary speakers, that is, $\mathbf{1}_{primary}$ with $\mathbf{1}_{secondary}$ and $\mathbf{2}_{primary}$ and $\mathbf{2}_{secondary}$. The stacking of the speakers may be either vertical or horizontal. Stacking of the speakers may be detectable by using a detector such as, for example a light sensor, a force sensor, a mechanical switch and the like. The detector may preferably be used on a surface of contact between the stacking speakers.

Generally, the primary speakers ($\mathbf{1}_{primary}$ and $\mathbf{2}_{primary}$) may also be known as main speakers while the secondary speakers ($\mathbf{1}_{secondary}$ and $\mathbf{2}_{secondary}$) may also be known as surround speakers. There may be a disparity in size and number of speaker drivers for the primary speakers and the secondary speakers.

The system 20 also includes an arrangement of electronic components (24, 26, 28, 30, 32, 34) for controlling output of audio signals from the first pair and the second pair of speakers. It is preferable that the arrangement of electronic components forms a device like, for example, low pass filter, high pass filter, band-pass filter, crosstalk canceller and any combination of the aforementioned. The electronic components may affect the response of the input signals prior to passing into the multiplexers 22.

First Mode: Speakers Unstacked

In a first mode with the first and second pair of speakers in an unstacked configuration which may be arranged in the manner as shown in FIG. 4, the input signals do not pass through the arrangement of electronic components prior to output, and thus are not processed prior to passing into the multiplexers 22. This is shown for the primary speakers in FIG. 1 and for the secondary speakers in FIG. 2 in paths labeled "unstacked". The input signals may be either stereophonic or multi-channel. It should be noted that in FIG. 2, there is only multi-channel (surround) output in the paths labeled "unstacked". It should be noted that there is no depiction of stereophonic input in an unstacked configuration in FIG. 2 as stereophonic input is generally only output through the primary speakers and not through the secondary speakers. This ensures either stereophonic output or multi-channel reproduction by the system 20 in accordance to an input to the system 20. Thus, sound reproduction using the system 20 is optimal as a user will be able to receive sound emanating from locations which are as originally intended.

Second Mode: Speakers Stacked

In a second mode with each of the first and second pair of speakers in a stacked configuration which may be arranged in the manner as shown in FIG. 5, the arrangement of electronic components (24, 26, 28, 30, 32, 34) in the system 20 allows either stereophonic signals or multi-channel audio signals to be separately processed prior to passing into the multiplexers 22 and reproduced in the first pair and the second pair of speakers. This is shown for the primary speakers in FIG. 1 and for the secondary speakers in FIG. 2 in paths labeled "stacked".

In FIG. 1, once the first pair and second pair of speakers are stacked, regardless of whether the input signals are either stereophonic or multi-channel, electronic components 24 and 26 process the input signals prior to the signals passing into the multiplexers 22.

In FIG. 2, when the input signal is stereophonic, electronic components 28 and 30 process the input signals prior to the signals passing into the multiplexers 22. When the input signal is in multi-channel format, electronic components 34 and 32 process the input signals prior to the signals passing into the multiplexers 22.

This ensures either stereophonic output or multi-channel reproduction by the system 20 in the second mode in accordance to an input to the system 20 as dispersion issues are minimized during stereophonic output and the user is still able to perceive surround sound during multi-channel signal output. Thus, sound reproduction using the system 20 is optimal.

If one pair of the speakers is stacked while the other is not stacked, audio output from the stacked pair of speakers would be in accordance with the second mode, while audio output from the unstacked pair of speakers would be in accordance with the first mode. It should be noted that the sound reproduction quality would be adversely affected due to the non-uniform nature of both the speaker arrangement and output signal reproduction.

Figure 3:
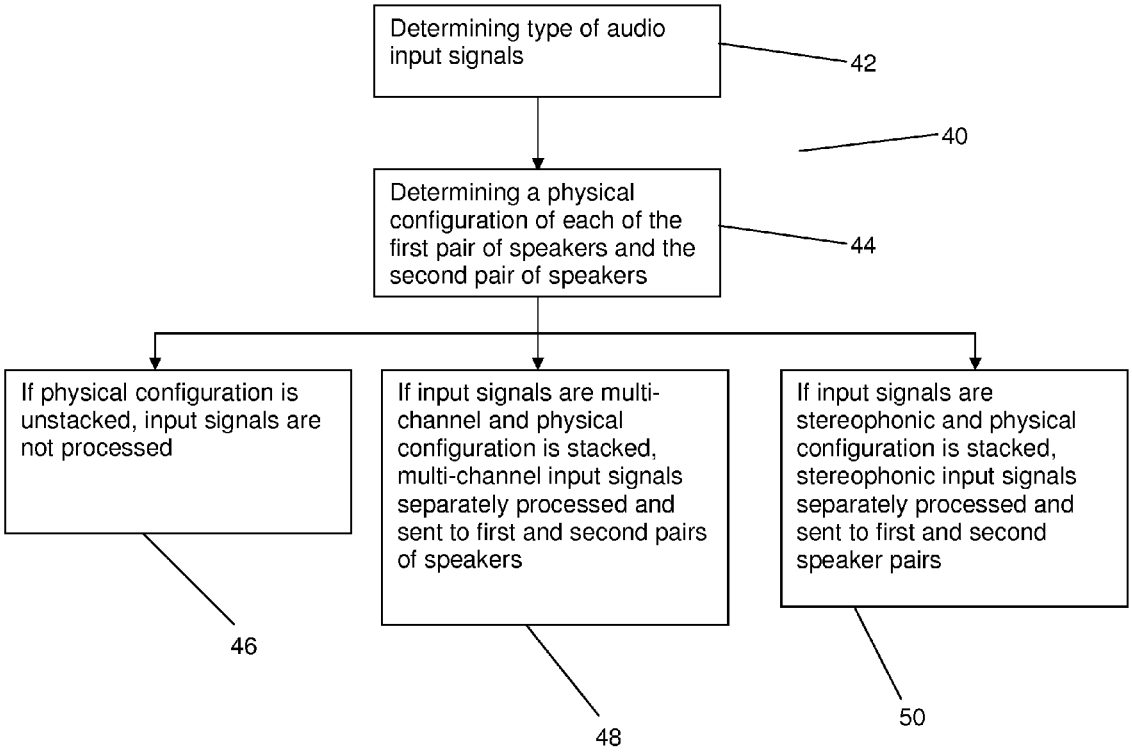
FIG. 3 shows a process flow of a preferred embodiment of the method.

In another aspect, there is shown in FIG. 3, a method 40 for reproduction of both stereophonic signals and multi-channel audio signals using a sound reproduction system. The sound reproduction system may include a first pair of speakers comprising a first primary speaker and a first secondary speaker, and a second pair of speakers comprising a second primary speaker and a second secondary speaker. The sound reproduction system may be similar to the system as described in the earlier aspect.

The method 40 includes determining whether input signals are either stereophonic or multi-channel (42). The determination of the type of input signals may be done by either a user defining the type of input signals or by analyzing the input signals. The method also includes determining a physical configuration of each of the first pair of speakers and the second pair of speakers (44). The physical configuration of each of the first pair of speakers and the second pair of speakers in relation to stacking may be detectable by using a detector such as, for example, a light sensor, a force sensor, a mechanical switch and the like. The detector may preferably be used on a surface of contact between the stacking speakers. Alternatively, the user may define the physical configuration. It should be noted that the stacked configuration may be either vertical or horizontal. Determination of the type of audio input and the physical configuration would aid in obtaining optimal audio output from the system.

If the physical configuration of each pair of speakers is not in a stacked configuration, input signals are not processed (46) regardless of whether the input signals are either stereophonic or multi-channel. This ensures either stereophonic output or multi-channel reproduction by the system in accordance to an input to the system. Thus, sound reproduction is optimal.

If the input signals are multi-channel while the physical configuration of each pair of speakers is in a stacked configuration, the multi-channel signals are processed separately (48) with electronic components like, for example, low pass filter, high pass filter, band-pass filter, crosstalk canceller and any combination of the aforementioned. The electronic components may affect the response of the input signals. This may ensure that the user is still able to perceive surround sound during multi-channel signal output. Thus, sound reproduction is optimal.

If the input signals are stereophonic while the physical configuration of each pair of speakers is in a stacked configuration, the stereophonic signals are also processed separately (50) with electronic components like, for example, low pass filter, high pass filter, band-pass filter, crosstalk canceller and any combination of the aforementioned. The electronic components may affect the response of the input signals. This may also ensure that the primary and secondary speakers are optimally integrated while in the stacked configuration to reproduce the stereophonic signal.

It should be understood that the aforementioned aspects and embodiments are not restricted to four speaker systems and may be applied to other multi-speaker setups with different numbers of speakers with or without subwoofers and other audio reproduction components.

Whilst there has been described in the foregoing description preferred embodiments of the present invention, it will be understood by those skilled in the technology concerned that many variations or modifications in details of design or construction may be made without departing from the present invention.

What is claimed is:

1. A multi-mode sound reproduction system for reproduction of both stereophonic signals and multi-channel audio signals, the system including:

at least one pair of speakers, each of the at least one pair of speakers comprising a primary speaker and a secondary speaker, the primary speaker being stackable with the secondary speaker;

an arrangement of electronic components for controlling output of audio signals from the at least one pair of speakers in a manner such that:

when the primary and secondary speakers are not stacked, the signals do not pass through the arrangement of electronic components and are thus unprocessed, and when the primary and secondary speakers are stacked, the arrangement of electronic components allows either stereophonic signals or multi-channel audio signals to be separately processed; and a multiplexer configurable to receive either the unprocessed signals or the separately processed signals, the multiplexer being further configurable to output either the unprocessed signals or separately processed signals via the at least one pair of speakers.

2. The system of claim 1, wherein the arrangement of electronic components forms a device selected from the group consisting of: low pass filter, high pass filter, band-pass filter, crosstalk canceller and any combination of the aforementioned.

3. The system of claim 1, wherein stacking of speakers is detectable by using a detector selected from the group consisting of: a light sensor, a force sensor, and a mechanical switch.

4. The system of claim 1, wherein stacking is either vertical or horizontal.

5. The system of claim 1, wherein each speaker includes at least one driver.

6. The system of claim 1, the at least one pair of speakers comprising:

a first pair of speakers positioned on a left portion of a user, the user being at a pre-determined facing, the first pair of speakers comprising a first primary speaker which is stackable with a first secondary speaker; and a second pair of speakers positioned on a right portion of the user, the user being at the pre-determined facing, the second pair of speakers comprising a second primary speaker which is stackable with a second secondary speaker.

7. The system of claim 6, wherein the pre-determined facing is towards the at least one driver of the primary speakers.

8. The system of claim 1, wherein the arrangement of electronic components includes a crosstalk canceller for processing multi-channel audio signals.

9. The system of claim 1 further comprising a multiplexer coupled to the arrangement of electronic components in a manner such that:

when the primary and secondary speakers are stacked, regardless whether the signals are stereophonic audio signals or multi-channel audio signals, the arrangement of electronic components are configured to process the signals prior to the signals being communicated to the multiplexer.

10. The system of claim 1 comprising at least two pairs of speakers, wherein if one pair of speakers is stacked while the other pair of speaker is not stacked, the arrangement of electronic components are configured to allow either stereophonic signals or multi-channel audio signals to be separately processed and reproduced in the stacked pair of speakers, and for the pair of stacked speakers not stacked, the signals do not pass through the arrangement of electronic components prior to output.

* * * * *